US007963663B2

(12) United States Patent
Simard

(10) Patent No.: US 7,963,663 B2
(45) Date of Patent: Jun. 21, 2011

(54) LIGHTING SYSTEM

(76) Inventor: Jo-Anne Simard, Laval (CA)

( * ) Notice: Subject to any disclaimer, the term of this patent is extended or adjusted under 35 U.S.C. 154(b) by 405 days.

(21) Appl. No.: 11/878,328

(22) Filed: Jul. 24, 2007

(65) Prior Publication Data

US 2009/0027880 A1 Jan. 29, 2009

(51) Int. Cl.
*F21V 9/00* (2006.01)

(52) U.S. Cl. ..... 362/231; 362/249.05; 362/295; 362/391

(58) Field of Classification Search ..... 362/231, 362/249.01, 249.02, 249.05, 249.12, 249.13, 362/249.14, 295, 391, 394, 806, 311.02, 362/311.13, 311.14
See application file for complete search history.

(56) References Cited

U.S. PATENT DOCUMENTS 3,868,671 A * 2/1975 Maguire et al. ..... 362/249.12
4,434,454 A * 2/1984 Day ..... 362/238
7,027,736 B1 * 4/2006 Mier-Langner et al. ..... 362/295

* cited by examiner

*Primary Examiner* — Y My Quach Lee

(57) ABSTRACT

A lighting system, the lighting system being usable in combination with coloured light sources to create a lighting scheme by providing electrical power to the coloured light sources, the lighting system comprising: at least two lamp modules, each of the lamp modules including a module base and a socket matrix mounted to the module base, each of the socket matrices having a predetermined number of sockets, each of the sockets being able to removably receive at least one of the coloured light sources and transmit electrical power thereto; at least two power transmission lines, each of the power transmission lines being electrically coupled to a respective socket in each of the socket matrices; and a controller for selectively providing the electrical power independently to each of the power transmission lines.

12 Claims, 3 Drawing Sheets

LIGHTING SYSTEM

FIELD OF THE INVENTION

The present invention relates to the general field decorative devices and is more particularly concerned with a lighting system.

BACKGROUND OF THE INVENTION

Lighting systems are used at many locations to provide decorations for many events. For example, a conventional lighting system includes a chain of sockets electrically coupled to wiring, each socket being able to receive a light bulb thereinto. Using light bulbs of different colours into the socket allows to create different lighting schemes with colours associated with specific events.

However, this type of system requires that all the lights be removed from their sockets to create a different lighting scheme. In cases in which the lighting system is positioned is relatively difficult to access positions, for example near the roof of a house or near the ceiling of a relatively large height room, there is a need to bring the lighting system down to ground level to change the light bulbs and, thereafter, to reposition the lighting system.

In addition to the inconvenience of performing all these steps, the fact that these lighting systems are often located at relatively large heights also poses a safety hazard, for example for home users who may be tempted to use less than optimal equipment to reach the elevated lighting systems.

U.S. Pat. No. 6,690,120 issued Feb. 10, 2004 to Oskorep et al, describes a decorative light strand having user selectable colour schemes corresponding to various Holidays. However, in this light strand, the light schemes are not interchangeable and, therefore, only a relatively small number of light schemes is provided for. In addition, in the decorative light strand described in this document, the lights are simply positioned sequentially one after the other in groups that repeat themselves. There is no provision for selecting a location at which lights of each group may be located. Therefore, the flexibility in the decorative schemes achievable using these decorative light strands are relatively limited.

Accordingly, there exists a need for an improved lighting system. It is a general object of the present invention to provide such a lighting system.

SUMMARY OF THE INVENTION

In a first broad aspect, the invention provides a lighting system, the lighting system being usable in combination with coloured light sources to create a lighting scheme by providing electrical power to the coloured light sources, the lighting system comprising:

- at least two lamp modules, each of the lamp modules including a module base and a socket matrix mounted to the module base, each of the socket matrices having a predetermined number of sockets, each of the sockets being able to removably receive at least one of the coloured light sources and transmit electrical power thereto;
- at least two power transmission lines, each of the power transmission lines being electrically coupled to a respective socket in each of the socket matrices; and
- a controller for selectively providing the electrical power independently to each of the power transmission lines;
- wherein the coloured light sources are mountable reversibly and interchangeably in each of the socket matrices to create predetermined light sources configurations into each of the at least two lamp modules and the controller provides selective distribution of power to the already mounted coloured light sources according to a predetermined pattern to create the lighting scheme by selectively illuminating independently from each other the coloured light sources in each of the predetermined light source configurations.

Advantageously, the proposed lighting system allows providing power to the lamp modules to create lighting schemes corresponding to various predetermined events without having to replace the coloured light sources. Also, the proposed lighting system provides flexibility in the lighting schemes that may be produced by allowing the coloured light sources to be exchanged, for example, after a sequence of predetermined events has occurred.

The fact that lighting schemes corresponding to many predetermined events may be set using the same lighting system therefore reduce the work required to install and uninstall the lighting system, and also may increase the safety of intended users as these intended users typically install such lighting systems in relatively hard to reach places. Also, the comfort of the intended user is increased as some of the lighting systems are usable outdoors, in which extremes of hot and cold temperatures may occur, depending on the geographic location at which the lighting system is installed. Therefore, the intended user may take advantage of good weather to exchange all the coloured lights versus of the lighting system to provide a lighting system that is usable for the next few predetermined events.

The coloured lights sources are any suitable light sources such as, for example, light bulbs or light emitting diodes.

The lamp modules group together light sources corresponding to each of the lighting schemes. Therefore, a location at which each of lamp modules is provided is illuminated selectively during the production of each lighting schemes.

In some embodiments of the invention, the lighting system is controllable using a remote control unit, which allows to select which one of the lighting schemes is activated at any time. This further increases the flexibility and safety of the lighting system.

In another broad aspect, the invention provides a method for changing a light scheme produced by a lighting system the method comprising:

- removing from the at least two lamp modules already mounted light sources, the already mounted light sources each having a respective colour, the already mounted light sources being mounted to sockets from each of the at least two lamp modules that are electrically coupled to a common power transmission line from the at least two power transmission lines, thereby creating empty sockets; and
- inserting in each of the empty sockets light sources having a colour that differs from the colour of the already mounted light sources that was mounted in the empty socket.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings, in which.

DETAILED DESCRIPTION

Figure 1:
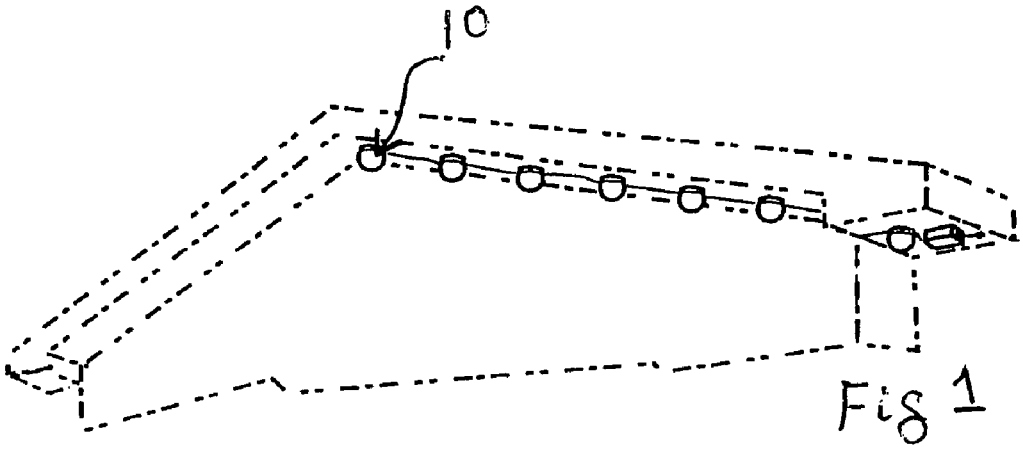
FIG. 1, in a perspective view with parts removed, illustrates a portion of a lighting system in accordance with an embodiment of the present invention, the lighting system including lamp modules, the lamp modules being shown attached to a building, the building being shown in phantom lines.
Figure 2:
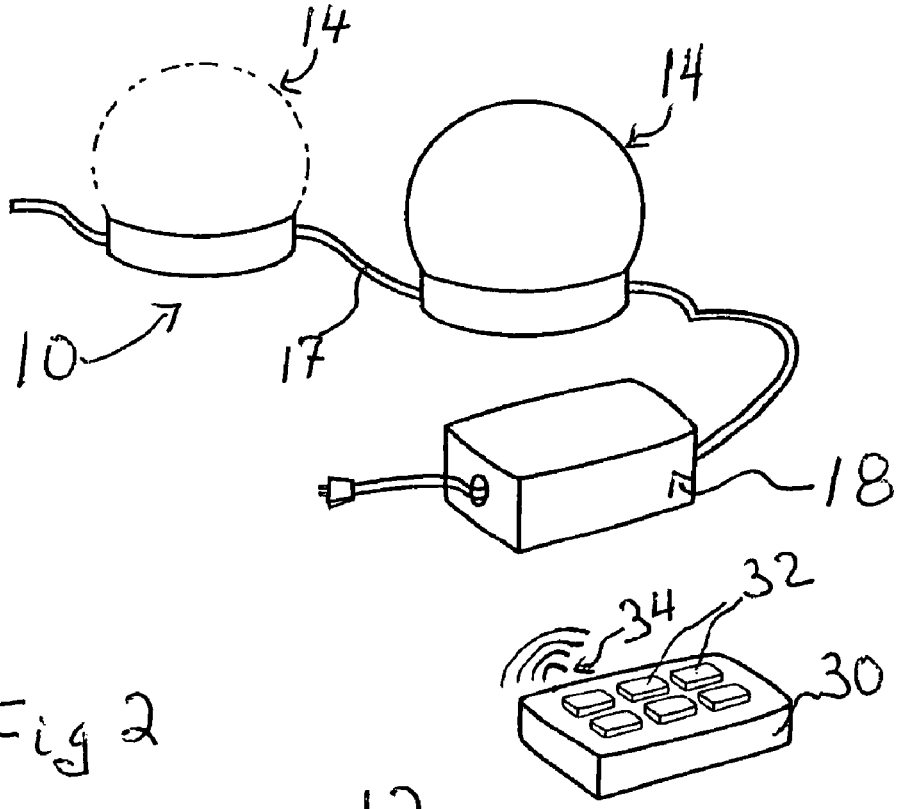
FIG. 2, in a perspective view with parts removed, illustrates the lighting system shown in FIG. 1.

FIG. 1 illustrates part of a lighting system 10 in accordance with an embodiment of the present invention. The lighting system, as better shown in FIG. 2, includes at least two lamp modules 14, at least two power transmission lines 16 (better seen in FIG. 4) and a controller 18. While only two lamp modules are shown in FIG. 2, it is within the scope of the present invention to have lighting system including more than two lamp modules as seen, for example, in FIG. 1. The lighting system 10 is usable in combination with coloured light sources 12 as seen, for example, in FIG. 3, to create a lighting scheme by providing electric power to the coloured light sources 12. For example, the lighting system 10 is attachable to a building 11 shown in phantom lines in FIG. 1. However, the lighting system 10 is usable in any other suitable location without departing from the scope of the claimed invention.

Figure 3:
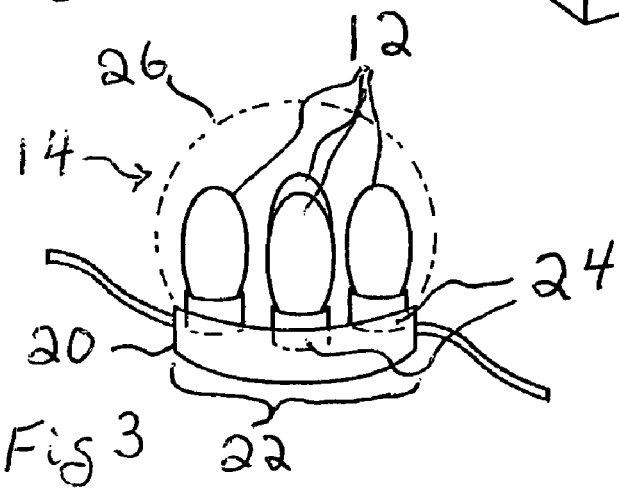
FIG. 3, in a perspective view, illustrates a lamp module of the lighting system shown in FIGS. 1 and 2.

Referring to FIG. 3, each of the lamp modules 14 includes a module base 20 and a socket matrix 22 mounted to the module base 20. Each of the socket matrices has a predetermined number of sockets 24. Each of the sockets 24 is able to removably receive at least one of the coloured light sources 12 and transmit electrical power thereto. For example, the coloured light sources 12 are light bulbs, light emitting diodes, or any other suitable coloured light sources.

Figure 4:
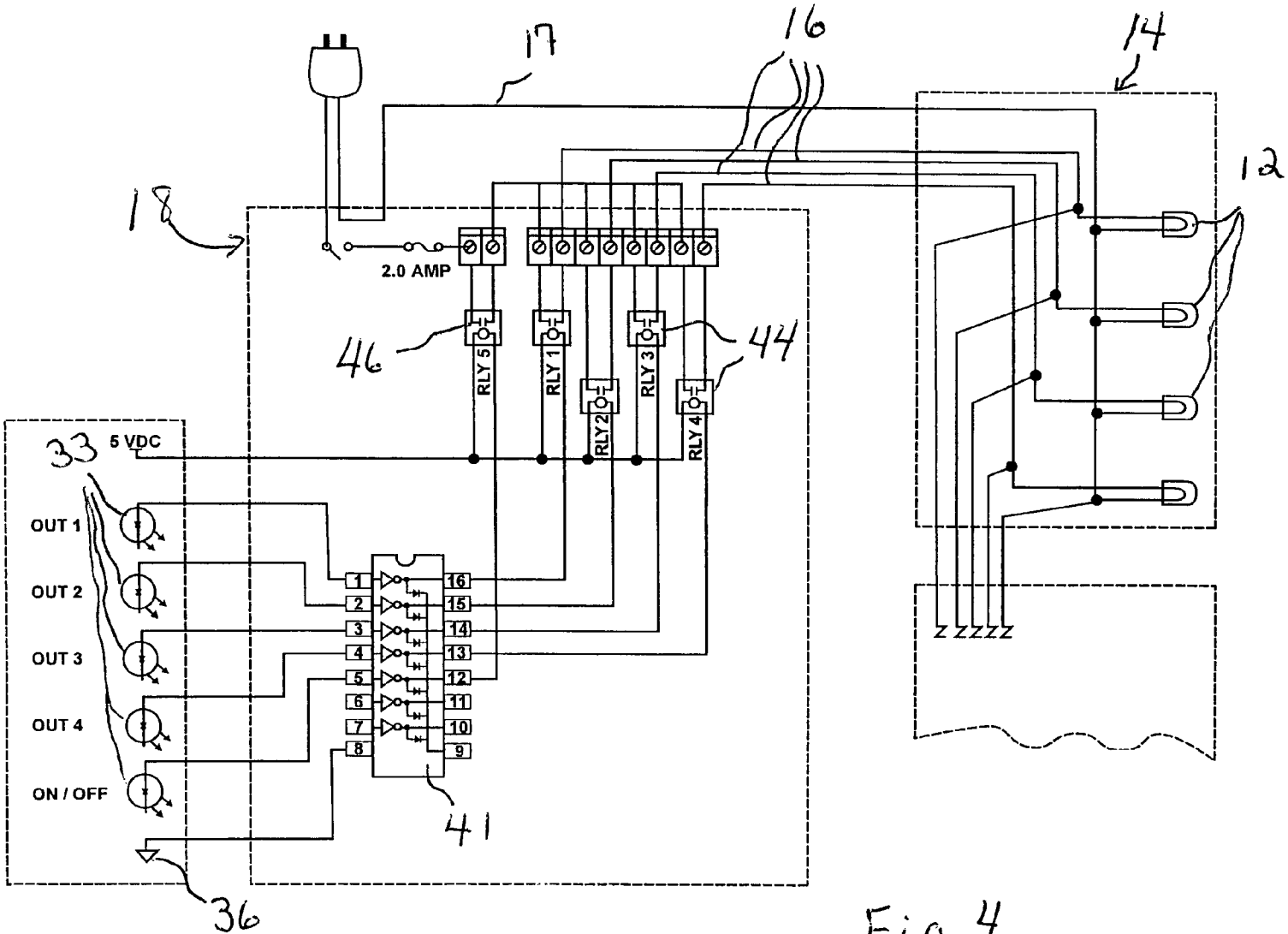
FIG. 4, in a schematic diagram, illustrates an electrical circuit of a specific embodiment of the lighting system of FIGS. 1 to 3.

As seen in FIG. 4, each of the power transmission lines 16 is electrically couplable to a respective socket 24 in each of the socket matrices 22. The controller 18 selectively provides the electric power independently to each of the power transmission lines 16, thereby controlling which coloured light sources within each socket matrices 22 receives electrical power.

In some embodiments of the invention, the power transmission lines 16 are mechanically coupled to each other to form a power transmitting cable 17 extending between adjacent lamp modules 14. Also, while the lighting system 10 shown in the drawings has socket matrices 22 including four sockets 24, and therefore four power transmission lines 16, the lighting system 10 may include any other suitable number of sockets 24 and power transmission lines 16.

Therefore, the coloured light sources 12 are mountable reversibly and interchangeably in each of the socket matrixes 22 to create predetermined light sources configurations in each of the at least two lamp modules 14. The controller 18 provides selective distribution of power to the already mounted coloured light sources 12 according to a predetermined pattern to create a lighting scheme by selectively illuminating independently from each other the coloured light sources 12 in each of the predetermined light sources configurations.

Figure 5:
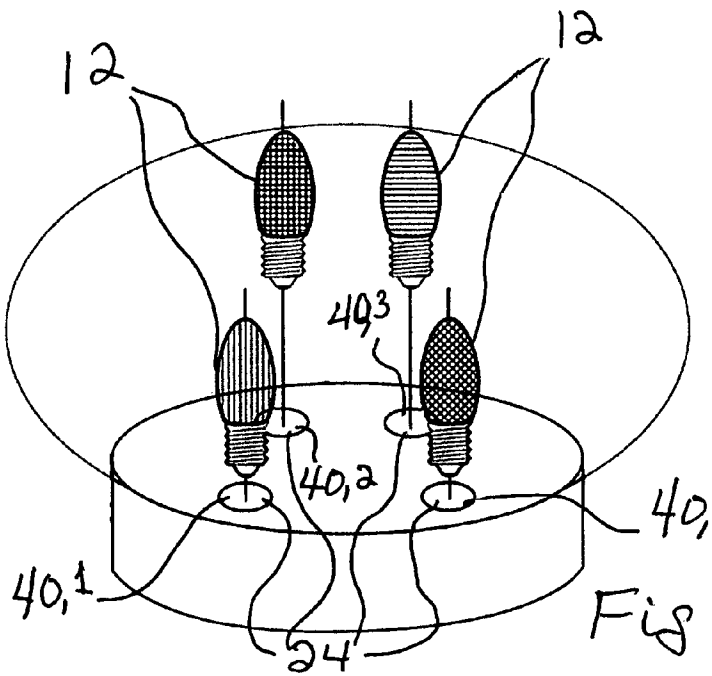
FIG. 5, in a perspective view, illustrates a lamp module of the lighting system shown in FIGS. 1 to 4, the lamp modules being shown with coloured light sources to be inserted thereinto.
Figure 6:
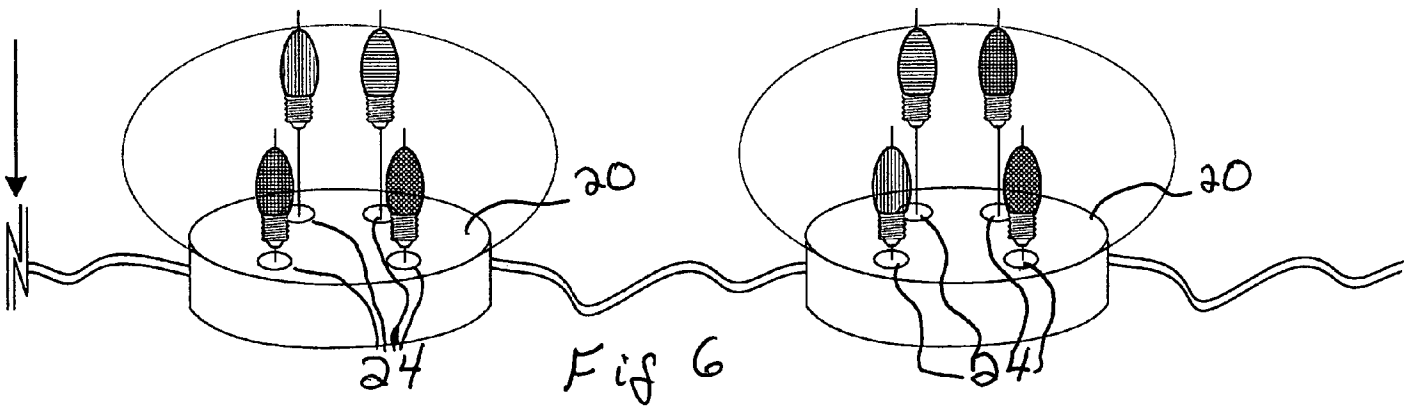
FIG. 6, in a perspective view, illustrates, two lamp modules of the lighting system shown in FIGS. 1 to 4, the lamp modules being shown with light sources having different colours than the light sources illustrated in FIG. 5.

FIGS. 5 and 6 illustrate two examples of different configurations of coloured light sources usable in the lighting system 10. Removing from the lamp modules 14 already mounted lights sources 12, the already mounted light sources 12 each having a respective colour, and inserting in each of the thereby produced empty sockets 24 light sources 12 having a colour that differs from the colour of the already mounted light sources 12 that was mounted in the empty socket allows to vary the lighting scheme that may be produced by the lighting system 10.

The lighting system 10 includes a user interface operatively coupled to the controller 12 for allowing the intended user to select at least one of the power transmission lines 16 to be powered by the controller 18. For example, and non-limitingly, the user interface includes a remote control unit 30. The remote control unit 30 includes an input element 32 for allowing the intended user to select at least one of the power transmission lines 16 that is to be powered by the controller 18, and an emitter 34 operatively coupled to the input element 32 for emitting a signal indicative of the at least one of the power transmission lines 16 to be powered by the controller 18 and selected by the intended user. A receiver 36, better seen in FIG. 4, is operatively coupled to the controller 18 for receiving the signal and instructing the controller 18 to power the at least one of the power transmission lines 16 to be powered by the controller 18.

For example, the input element 32 includes keys that may be depressed by an intended user. Depressing each key results in a different signal being sent to the receiver 36, which therefore may interpret the signals and instruct the controller 18 to power one of the power transmission lines 16.

In some embodiments of the invention, the remote control unit 30 is a dedicated remote control unit. However, in alternative embodiments of the invention, the remote control unit 30 is an already existing remote control unit 30 such as, for example, a universal remote controller or a TV remote controller, among other possibilities. In these embodiments, the receiver 36 may be a programmable receiver that may be programmed to recognize predetermined key depressions on the remote control unit 30.

In some embodiments of the invention, the receiver 36 includes a receiver input element 33 for allowing the intended user to select the at least one of the power transmission lines to be powered by the controller 18. The receiver 36 is then operative for instructing the controller 18 to power the at least one of the power transmission lines 16 to be powered by the controller 18 selected by the intended user through the receiver input elements 33. For example, the receiver input element 33 includes push buttons that may send electrical signals to the controller 18, the control signals being indicative of the which power transmission lines 16 is to be controlled.

In yet other embodiments of the invention, the controller 18 is operative for alternatively providing the electrical power independently to each of the power transmission lines 16 according to a pre-established schedule. An example of such an embodiment would be an example in which the controller 18 included time tracking capabilities and would therefore be capable of determining at which moment in the year the lighting system 10 is used. Then, by providing to an intended user schedules for exchanging coloured light sources 12 in the lighting system 10, the controller 18 may select which ones of the power transmission lines 16 is to be power on depending on the date at which the lighting system 10 is used.

For example, coloured light sources 12 having colours associated with Christmas may be mounted into sockets 24 electrically coupled to a first power transmission line 16 and coloured light sources 12 having colours associated with Valentine's day may be mounted into sockets 24 electrically coupled to a second power transmission line 16. To illuminate the coloured light sources 12 having colours associated with Christmas, for example from December 1 to January 15, the controller 18 provides power to the first power transmission line 16. Afterwards, for example from January 15 to February 14, the controller 18 provides power to the second power transmission line 16 to create a lighting scheme associated with Valentine's day. Lighting schemes are produced in a similar manner for different occasions until all the power transmission lines have been used. Then, if there is a need to have additional lighting schemes, time has come to change the coloured light sources for alternative couloured light sources to provide a capability to provide these additional lighting schemes. In this case, the intended user replaces the coloured light sources 12 according to instructions provided by the lighting system 10 manufacturer. In some embodiments of the invention, there are selected time periods within the year in which none of the power transmission lines 16 are activated.

In some embodiments of the invention, the controller 18 is operative for selectively providing the electrical power independently to a selected one of the power transmission lines 16 according to a predetermined time varying pattern. For example, the light for the power transmission lines 16 that are activated may be flashing periodically in time. In these embodiments, only one of the power transmission lines 16 is used at a time, but the decorative effect produced by the non-uniform power transmission as a function of time in the power transmission lines 16 is enhanced.

As seen, for example, in FIG. 3, in specific embodiments of the invention, the lighting system 10 includes lamp modules 14 that each include a respective dome 26. The domes 26 are each removably attachable to a respective one of the bases 20 so as to enclose the coloured light sources 12 received in the sockets 24 of the socket matrix 22 included in each of the lamp modules 14. Manners of attaching such domes 26 to bases 24 are well-known in the art and will therefore not be described in further details. The domes 26 therefore protect the coloured light sources 12 from the elements, and also help to define each of the lamp modules 14 as distinct units. In some embodiments of the invention, this is further achieved by adding lamp modules 14 that include domes 26 that are translucent.

In some embodiments of the invention, the lighting system 10 includes two sets of domes 26. The first set of domes 26 includes domes 26 of a first type, the domes 26 of the first type having a first light transmission characteristic. The second set of domes 26 includes domes 26 of a second type, the domes 26 of the second type having a second light transmission characteristic that differs from the first light transmission characteristic. Therefore, by exchanging the domes 26 that are attached to the module bases 20, further decorative effects may be produced using the lighting system 10. For example, the first and second light transmission characteristics have different light transmission spectra. In this case, the first and second set of domes may add a distinct tint to the light produced by the lamp modules 14.

In some embodiments of the invention, the lighting system 10 is provided with coloured light sources 12 relating to predetermined events. Examples of such predetermined events include Christmas, Easter, Valentine Day, Halloween and many others. It is also within the scope of the invention to have coloured light sources 12 that correspond to non-traditional events such as, for example, coloured light sources 12 that produce a lighting scheme associated with the birthdays of each member of a family. In this embodiment, each family member would select a scheme of coloured light sources that they would like to see on or close to their birthday, and the lighting system 10 is simply used to display these coloured light sources 12 at the appropriate moment.

Referring to FIG. 5, in some embodiments of the invention, the module base 20 includes indicia 40 inscribed thereunto. Each of the indicia 40 is substantially adjacent a respective one of the sockets 24 and is indicative of which power transmission line 16 powers the socket 16 to which it is adjacent. For example, the indicia 40 may be Roman numerals that are associated with similar indicia located on the user interface. The indicia may be printed, embossed, engraved or inscribed unto the module base 20 in any suitable manner.

FIG. 4 illustrates the electrical circuit of a lighting system 10 in accordance with an embodiment of the present invention. While a specific circuit is described hereinbelow, the reader skilled in the art will readily appreciate that the controller 18 may be implemented in any other suitable manner. The controller 18 includes a selector chip 41 electrically connected to a set of relays 44. The relays 44 are powered by standard home alternating current. Each of the relays 44 allow to select which of the power transmission lines 16 will be powered by this alternating current by closing a circuit formed by a respective one of the power transmission lines 16 and a return line 17. Each of the relay 44 is selectively switchable to a closed state when the intended user instructs the controller 18 to close this relay through the input elements 32 and 33. Also, the selector chip 41 is operative for opening all the relays electrically coupled to the power transmission lines 16, except for a single relay 44. In some embodiments of the invention, a main power relay 46 also allows selectively allow and prevent power transmission to the relays 44, the main power relay 46 being selectively activatable by the intended to control the turning on and off of the lighting system 10.

Although the present invention has been described hereinabove by way of preferred embodiments thereof, it can be modified, without departing from the spirit and nature of the subject invention as defined in the appended claims.

What is claimed is:

1. A lighting system, said lighting system being usable in combination with coloured light sources to create a lighting scheme by providing electrical power to said coloured light sources, said lighting system comprising:

at least two lamp modules, each of said lamp modules including a module base and a socket matrix mounted to said module base, each of said socket matrices having a predetermined number of sockets, each of said sockets being able to removably receive at least one of said coloured light sources and transmit electrical power thereto, each of said lamp modules including a respective dome, each of said domes being removably attachable to a respective one of said module bases so as to enclose said colored light sources received in said sockets of said socket matrix included in said lamp module to which said dome is attached;

at least two power transmission lines, each of said power transmission lines being electrically coupled to a respective socket in each of said socket matrices; and a controller for selectively providing said electrical power independently to each of said power transmission lines;

wherein said coloured light sources are mountable reversibly and interchangeably in each of said socket matrices to create predetermined light sources configurations into each of said at least two lamp modules and said controller provides selective distribution of power to said already mounted coloured light sources according to a predetermined pattern to create said lighting scheme by selectively illuminating independently from each other said coloured light sources in each of said predetermined light source configurations.

2. A lighting system as defined in claim 1, said lighting system being usable by an intended user, said lighting system further comprising a user interface operatively coupled to said controller for allowing said intended user to select at least one of said power transmission lines to be powered by said controller.

3. A lighting system as defined in claim 2, wherein said user interface includes a remote control unit, said remote control unit including an input element for allowing said intended user to select said at least one of said power transmission lines to be powered by said controller and an emitter operatively coupled to said input element for emitting a signal indicative of said at least one of said power transmission lines to be powered by said controller selected by said intended user; and a receiver operatively coupled to said controller for receiving said signal and instructing said controller to power said at least one of said power transmission lines to be powered by said controller.

4. A lighting system as defined in claim 3, wherein said receiver further includes a receiver input element for allowing said intended user to select said at least one of said power transmission lines to be powered by said controller, said receiver being operative for instructing said controller to power said at least one of said power transmission lines to be powered by said controller selected by said intended user through said receiver input element.

5. A lighting system as defined in claim 1, wherein said controller is operative for alternatively providing said electrical power independently to each of said power transmission lines according to a pre-established schedule.

6. A lighting system as defined in claim 1, wherein said controller is operative for selectively providing said electrical power independently to a selected one of said power transmission lines according to a predetermined time-varying pattern.

7. A lighting system as defined in claim 1, wherein said lighting system includes a first set of domes including domes of a first type, said domes of said first type having a first light transmission characteristic; and a second set of domes including domes of a second type, said domes of said second type having a second light transmission characteristic that differs from said first light transmission characteristic.

8. A lighting system as defined in claim 7, wherein said first and second light transmission characteristics have different light transmission spectra.

9. A lighting system as defined in claim 1, wherein selectively providing said electrical power independently to each of said power transmission lines creates different lighting schemes, each of said lighting schemes corresponding to a respective predetermined events.

10. A lighting system as defined in claim 1, wherein each of said coloured light sources include a light bulb.

11. A lighting system as defined in claim 1, wherein each of said coloured light sources includes a light emitting diode (LED).

12. A lighting system as defined in claim 1, wherein said module base includes indicia inscribed thereonto, each of said indicia being substantially adjacent a respective one of said sockets and indicative of which power transmission line powers said respective one of said sockets.

* * * * *